US009736596B2

(12) United States Patent
Kim et al.

(10) Patent No.: US 9,736,596 B2
(45) Date of Patent: Aug. 15, 2017

(54) MICROPHONE

(71) Applicant: Hyundai Motor Company, Seoul (KR)

(72) Inventors: Hyunsoo Kim, Seoul (KR); Ilseon Yoo, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/946,000

(22) Filed: Nov. 19, 2015

(65) Prior Publication Data

US 2017/0013355 A1 Jan. 12, 2017

(30) Foreign Application Priority Data

Jul. 7, 2015 (KR) ..... 10-2015-0096814

(51) Int. Cl.

| | |
|---|---|
| ***H04R 19/04*** | (2006.01) |
| ***H04R 1/40*** | (2006.01) |
| ***H04R 3/00*** | (2006.01) |
| ***H04R 1/04*** | (2006.01) |
| ***H04R 19/00*** | (2006.01) |

(52) U.S. Cl.

CPC ..... *H04R 19/04* (2013.01); *H04R 1/04* (2013.01); *H04R 1/406* (2013.01); *H04R 3/005* (2013.01); *H04R 19/005* (2013.01); *H04R 2201/003* (2013.01); *H04R 2410/01* (2013.01)

(58) Field of Classification Search

CPC ..... H04R 19/005; H04R 1/04; H04R 1/06; H04R 1/406; H04R 2201/003; B81B 2201/0257; B81B 2201/0264; B81C 1/0023

See application file for complete search history.

(56) References Cited

U.S. PATENT DOCUMENTS

| | | | | |
|---|---|---|---|---|
| 8,170,244 | B2 * | 5/2012 | Ryan | H04R 1/406 381/174 |
| 8,300,870 | B2 * | 10/2012 | Lee | H04R 1/406 381/352 |
| 8,804,982 | B2 * | 8/2014 | Michel | H04R 1/406 381/111 |
| 8,824,719 | B2 * | 9/2014 | Tanaka | H04R 19/04 381/355 |
| 9,301,033 | B2 * | 3/2016 | Han | H04R 1/406 |
| 9,363,595 | B2 * | 6/2016 | Horibe | H04R 1/406 |
| 2008/0037768 | A1 * | 2/2008 | Hsu | H04M 1/03 379/429 |

(Continued)

FOREIGN PATENT DOCUMENTS

| | | |
|---|---|---|
| JP | 4505035 | 7/2010 |
| KR | 10-0631285 B1 | 10/2006 |
| KR | 10-0874470 | 12/2008 |

*Primary Examiner* — Matthew Eason

(74) *Attorney, Agent, or Firm* — Mintz Levin Cohn Ferris Glovsky and Popeo, P.C.; Peter F. Corless

(57) ABSTRACT

A microphone includes a case including a plurality of sound holes; a first sound device installed at positions corresponding to at least two sound holes in the case; a second sound device spaced apart from the first sound device in the case and installed at a position corresponding to at least one sound hole; and a semiconductor chip electrically connected to the first sound device and the second sound device, where the at least two sound holes formed in the positions corresponding to the first sound device are each formed in upper and lower surfaces of the case on the basis of the first sound device.

14 Claims, 3 Drawing Sheets

(56) References Cited

U.S. PATENT DOCUMENTS

| | | | | |
|---|---|---|---|---|
| 2011/0293126 | A1* | 12/2011 | Maekawa | H04R 19/005 381/355 |
| 2012/0300969 | A1* | 11/2012 | Tanaka | H04R 19/005 381/355 |
| 2013/0070951 | A1* | 3/2013 | Tanaka | H04R 1/38 381/361 |
| 2014/0226836 | A1* | 8/2014 | Miyatake | H04R 1/1083 381/94.1 |
| 2014/0233756 | A1* | 8/2014 | Inoda | H04R 1/38 381/91 |
| 2015/0035094 | A1* | 2/2015 | Laermer | H04R 19/005 257/416 |
| 2016/0241953 | A1* | 8/2016 | Elian | H04R 1/083 |

* cited by examiner

MICROPHONE

CROSS-REFERENCE TO RELATED APPLICATION

This application claims under 35 U.S.C. §119(a) the benefit of Korean Patent Application No. 10-2015-0096814 filed in the Korean Intellectual Property Office on Jul. 7, 2015, the entire contents of which are incorporated herein by reference.

BACKGROUND (a) Field of the Invention

The present invention relates to a microphone, and more particularly, to a microphone that outputs a uni-directional signal to improve sensitivity.

(b) Description of the Related Art

In general, a microphone, which is an apparatus converting voice into an electrical signal, has gradually miniaturized in recent years, and consequently, the microphone using micro electro mechanical system (MEMS) technology has been developed.

The above-mentioned MEMS microphone has advantages of tolerance to heat and humidity as compared to a conventional electric condenser microphone (ECM), and may be miniaturized and integrated with a signal processing circuit.

The MEMS microphone (hereinafter, simply referred to as a microphone) is classified into a capacitive type and a piezoelectric type.

First, the microphone of the capacitive type is configured as a fixed membrane and a vibration membrane, and when external sound pressure is applied to the vibration membrane, a capacitance value is changed while an interval between the fixed membrane and the vibration membrane is changed. In this case, the sound pressure is measured by using the capacitance value.

On the other hand, the microphone of the piezoelectric type is configured as only the vibration membrane, and when the vibration membrane is deformed by external sound pressure, the electrical signal is generated by a piezoelectric effect, such that the sound pressure is measured.

In addition, the microphone is classified into an omnidirectional microphone and a directional microphone depending on directional characteristics, and the directional microphone is classified into a bi-directional microphone and a uni-directional microphone.

Here, the bi-directional microphone performs a reproduction for front and rear incident sounds and exhibits attenuation characteristics for sound which is incident at a lateral angle, such that a polar pattern indicating input sensitivity of all directions on the basis of a diaphragm of the microphone is indicated in a figure of eight.

Since the bi-directional microphone has suitable near field characteristics, it is used as a microphone for an announcer of a stadium in which ambient noise is loud.

On the other hand, the uni-directional microphone maintains an output value in response to wide front incident sound and exhibits attenuation characteristics for rear incident sound, thereby improving a signal to noise (S/N) ratio for a front sound source. It is characterized that the uni-directional microphone is suitable for use as an equipment for recognizing a voice due to good articulation.

However, the conventional directional microphone as described above uses a scheme that implements directional characteristics using two omnidirectional sound devices.

This is a scheme that obtains directional characteristics by delaying sound input to the two sound devices using a digital signal processor (DSP), and there are problems that costs are increased due to an addition of a corresponding block in the digital signal processor and a size is also increased.

The above information disclosed in this Background section is only for enhancement of understanding of the background of the invention and therefore it may contain information that does not form the prior art that is already known in this country to a person of ordinary skill in the art.

SUMMARY

The present invention provides a microphone having advantages of outputting a uni-directional signal by forming a plurality of omnidirectional sound devices in a single package and coupling a bi-directional signal and an omnidirectional signal output from the plurality of omnidirectional sound devices, respectively.

An exemplary embodiment of the present invention provides a microphone including: a case including a plurality of sound holes; a first sound device installed at a position corresponding to at least two sound holes in the case; a second sound device spaced apart from the first sound device in the case and installed at a position corresponding to at least one sound hole; and a semiconductor chip electrically connected to the first sound device and the second sound device, wherein the at least two sound holes formed in the positions corresponding to the first sound device are each formed in upper and lower surfaces of the case on the basis of the first sound device.

The first sound device and the second sound device may be omnidirectional sound devices.

The first sound device may receive sound source signals through each of at least two sound holes formed in the upper and lower surfaces of the case and transmit a first sound output signal, which is a bi-directional signal, to the semiconductor chip.

The semiconductor chip may receive a second sound output signal, which is an omnidirectional signal, from the second sound device, and output a final sound signal, which is a uni-directional signal, using the first sound output signal and the second sound output signal.

The semiconductor chip may be electrically connected to each of the first sound device and the second sound device by a wire.

The semiconductor chip may be positioned on the second sound device.

The first sound device and the second sound device may include a first contact hole and a second contact hole each formed in one side of the substrate; and a first connection part and a second connection part formed in the first contact hole and the second contact hole, respectively.

The case may further include an electrode line that electrically connects the first connection part and the second connection part to each other.

The semiconductor chip may be electrically connected to the second sound device through a bonding part on the second sound device.

The electrode line and the bonding part may be formed of the same material.

Another embodiment of the present invention provides a microphone comprising: a first sound device receiving a sound source signal and outputting a first sound output signal; a second sound device formed to be spaced apart from the first sound device by a predetermined interval, receiving the sound source signal and outputting a second sound output signal; a case in which the first sound device and the second sound device are positioned, a first sound hole and a second sound hole are formed in an upper side and a lower side of the first sound device, and a third sound hole is formed in a position corresponding to the second sound device; and a semiconductor chip positioned on the second sound device and outputting a final sound signal based on the first sound output signal and the second sound output signal.

The first sound device may receive the sound source signal through each of the first sound hole and the second sound hole and transmit the first sound output signal, which is a bi-directional signal, to the semiconductor chip, and the second sound device may receive the sound source signal through the third sound hole and transmit the second sound output signal, which is an omnidirectional signal, to the semiconductor chip.

The semiconductor chip may output the final sound signal, which is a uni-directional signal, using the first sound output signal and the second sound output signal.

Yet another embodiment of the present invention provides a microphone including a case including first to third sound holes; a first sound device positioned between the first sound hole and the second sound hole in the case; a second sound device formed at a position corresponding to the third sound hole in the case; and a semiconductor chip positioned on the second sound device, wherein the first sound device and the second sound device are electrically connected to each other through a first connection part and a second connection part which are each formed on one side of a substrate.

The first connection part and the second connection part may be each formed in a first contact hole and a second contact hole formed in one side of each of the first sound device and the second sound device.

The case may further include an electrode line that electrically connects the first connection part and the second connection part to each other.

The semiconductor chip may be electrically connected to the second sound device through a bonding part on the second sound device.

According to an exemplary embodiment of the present invention, after the omnidirectional microphone is implemented as the bi-directional microphone using the sound hole formed in the case in which two omnidirectional microphones are installed, the signal of the omnidirectional microphone and the signal of the bi-directional microphone are electrically coupled to each other to implement the uni-directional microphone, thereby making it possible to improve sensitivity.

That is, according to an exemplary embodiment of the present invention, the two omnidirectional microphones and the semiconductor chip are electrically connected to each other to simultaneously form the signal of the omnidirectional microphone and the signal of bi-directional microphone in the single package, such that the uni-directional microphone is implemented, thereby making it possible to implement miniaturization and reduce costs at the same time.

Other effects that may be obtained or predicted from the exemplary embodiments of the present invention will be explicitly or implicitly disclosed in the detailed description of the exemplary embodiments of the present invention. That is, various effects predicted according to the exemplary embodiments of the present invention will be disclosed in the detailed description to be described below.

DETAILED DESCRIPTION OF THE EMBODIMENTS

Figure 1:
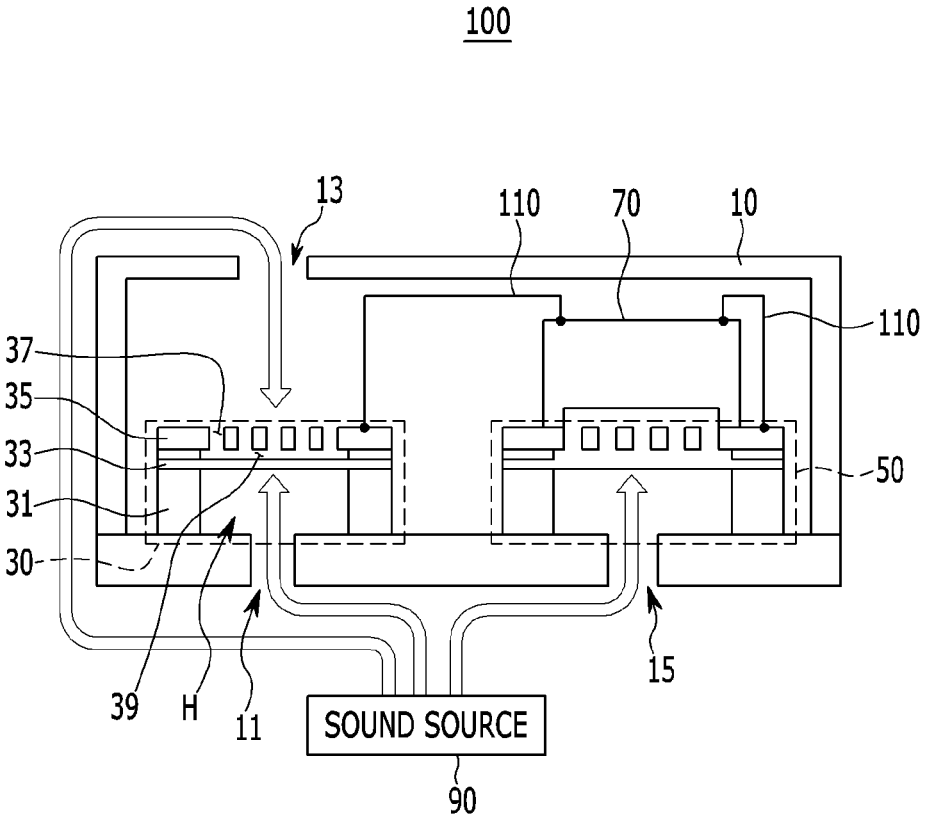
FIG. 1 is a configuration diagram illustrating a microphone according to an exemplary embodiment of the present invention.

Hereinafter, exemplary embodiments of the present invention will be described with reference to the accompanying drawings.

In order to explicitly describe the present invention, portions which are not associated with the description will be omitted. Like reference numerals designate like elements throughout the specification.

Hereinafter, exemplary embodiments of the present invention will be described with reference to the accompanying drawings. However, the drawings illustrated below and the detailed description to be described below relate to one exemplary embodiment among several exemplary embodiments for effectively describing characteristics of the present invention. Therefore, the present invention should not be limited to only the following drawings and description.

In addition, in describing the present invention, a detailed description for well-known functions or configurations will be omitted in the case in which it is determined that the detailed description may unnecessarily obscure the gist of the present invention. In addition, the following terminologies are defined in consideration of the functions in the present invention and may be construed in different ways by the intention of users and operators, a custom, or the like. Therefore, the definitions thereof should be construed based on the contents throughout the present invention.

In addition, in the following exemplary embodiments, in order to efficiently describe critical technical characteristics of the present invention, the terminologies are appropriately deformed, integrated, or separated to be used so that those skilled in the art may clearly understand, but the present invention is not necessarily limited thereto.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

FIG. 1 is a configuration diagram illustrating a microphone according to an exemplary embodiment of the present invention.

Referring to FIG. 1, a microphone 100 according to an exemplary embodiment of the present invention includes a case 10, a first sound device 30, a second sound device 50, and a semiconductor chip 70.

First, the case 10 includes a plurality of sound holes 11, 13, and 15, and the plurality of sound holes may be configured as a first sound hole 11, a second sound hole 13, and a third sound hole 15.

With respect to the plurality of sound holes 11, 13, and 15, the first sound hole 11 is formed in a lower portion of the case 10, the second sound hole 13 is formed in an upper portion of the case 10 at a position corresponding to the first sound hole 11, and the third sound hole is formed in the lower portion of the case 10 at a position which is spaced apart from the first sound hole 11 by a predetermined interval.

In this case, it is preferable to form the first sound hole 11 and the second sound hole 13 in opposite directions.

Although the arrangement in which three sound holes 11, 13, and 15 of the microphone 100 according to an exemplary embodiment of the present invention are formed in the case 10 has described by way of example, the number of sound holes 11, 13, and 15 is not necessarily limited thereto, but may be changed, if necessary.

The first sound hole 11, the second sound hole 13, and the third sound hole 15 are holes through which a sound source signal 90 is introduced from the outside, and the sound source signal introduced through the first to third sound holes 11, 13, and 15 is transmitted to the first sound device 30 and the second sound device 50, respectively.

The sound source signal 90 may be generated by an instruction of a user using a voice command.

In addition, the case 10 including the first to third sound holes 11, 13, and 15 as described above may be formed of any one of a metal material and a ceramic material.

In addition, the case 10 may be formed in any one of a cylindrical shape and a square pillar shape.

In addition, the first sound device 30 may be installed at positions corresponding to at least two sound holes in the case 10, and the at least two sound holes may be the first and second sound holes 11 and 13.

That is, the first sound device 30 is positioned between the first sound hole 11 and the second sound hole 13 which are formed in the case.

The first sound device 30 receives the sound source signal 90 from the outside and outputs a first sound output signal.

The first sound output signal is formed of a bi-directional signal.

That is, the first sound device 30 serves to receive the sound source signal 90 through the first sound hole 11 and the second sound hole 13 and transmit the first sound output signal, which is the bi-directional signal, to the semiconductor chip 70.

In addition, the second sound device 50 may be installed at a position corresponding to at least one sound hole in the case 10, and the at least one sound hole includes the third sound hole 15.

That is, the first and second sound holes 11 and 13 are each formed in an upper side surface and a lower side surface of the case 10 on the basis of the first sound device 30, and the third sound hole 15 is formed in the same surface as that of the first sound hole 11 to be spaced apart from the first sound hole 11 by a predetermined interval.

The second sound device 50 receives the sound source signal from the sound source 90 and outputs a second sound output signal.

In this case, the second sound output signal is formed of an omnidirectional signal.

That is, the second sound device 50 serves to receive the sound source signal 90 through the third sound hole 15 and transmit the second sound output signal, which is the omnidirectional signal, to the semiconductor chip 70.

The first and second sound devices 30 and 50 are configured as an omnidirectional sound device.

Although the case in which two omnidirectional sound devices 30 and 50 of the microphone 100 according to an exemplary embodiment of the present invention are installed side by side to be adjacent to each other in the case 10 has been described by way of example, the position of the first and second sound devices 30 and 50 is not necessarily limited thereto, but may be changed, if necessary.

Here, the first and second sound devices 30 and 50 may be formed by using a micro electro mechanical system (MEMS) technology, and the first and second sound devices 30 and 50 are configured as a substrate, a vibration membrane, and a fixed membrane.

Here, the configuration of the sound device based on the MEMS technology will be simply described using the first sound device 30 as an example. First, the substrate 31 may be formed of silicon, and a through hole H is formed in the substrate 31. In addition, the vibration membrane 33 is exposed by the through hole H and is disposed on the substrate 31. In addition, the fixed membrane 35 is disposed to be spaced apart from the vibration membrane 33 by a predetermined interval, and the fixed membrane 35 includes a plurality of air inlets 37. The vibration membrane 33 and the fixed membrane 35 are disposed to be spaced apart from each other by a predetermined interval. A space formed by the predetermined interval forms an air layer 30 to serve to prevent the vibration membrane 33 and the fixed membrane 35 from being in contact with each other. Similarly, the second sound device 50 may also be formed in the same way as the first sound device 30.

Here, an operation mechanism of the microphone 100 based on the MEMS technology will be simply described. In the microphone 100, the sound source signal generated from the sound source 90 is input to the vibration membrane 33 through the plurality of air inlets 37. Thus, the vibration membrane 33 is vibrated and the interval between the vibration membrane 33 and the fixed membrane 35 is changed. As a result, capacitance between the vibration membrane 33 and the fixed membrane 35 is changed, and the changed capacitance is converted into an electrical signal, which is sensed by a circuit.

Meanwhile, the semiconductor chip 70 is mounted on the second sound device 50 and is operated in response to an input signal.

However, although the case in which the semiconductor chip 70 is mounted on the second sound device 50 has been described by way of example, the position of the semiconductor chip 70 is not necessarily limited thereto, but the semiconductor chip 70 may be installed at any position as long as it is a position capable of obtaining the same effect as the exemplary embodiment of the present invention.

In addition, the semiconductor chip 70 may be an application specific integrated circuit (ASIC).

The semiconductor chip 70 receives the second sound output signal, which is the omnidirectional signal, from the second sound device 50. In addition, the semiconductor chip 70 receives the first sound output signal, which is the bi-directional signal, from the first sound device 30.

The semiconductor chip 70 outputs a final sound signal, which is the uni-directional signal, using the first sound output signal and the second sound output signal.

The semiconductor chip 70 configured as described above may be bonded to the first and second sound devices 30 and 50 by a wire bonding in which the semiconductor chip 70 and the first and second sound devices 30 and 50 are connected to each other by a wire 110.

As such, in the microphone 100 according to the exemplary embodiment of the present invention, since the first sound device 30 generates the bi-directional signal by the sound signal input through the first and second sound holes 11 and 13 and the semiconductor chip 70 couples a signal of the first sound device 30 and a signal of the second sound device 50 to thereby output the final sound signal, which is the uni-directional signal, a uni-directional microphone 100 may be implemented.

Figure 2:
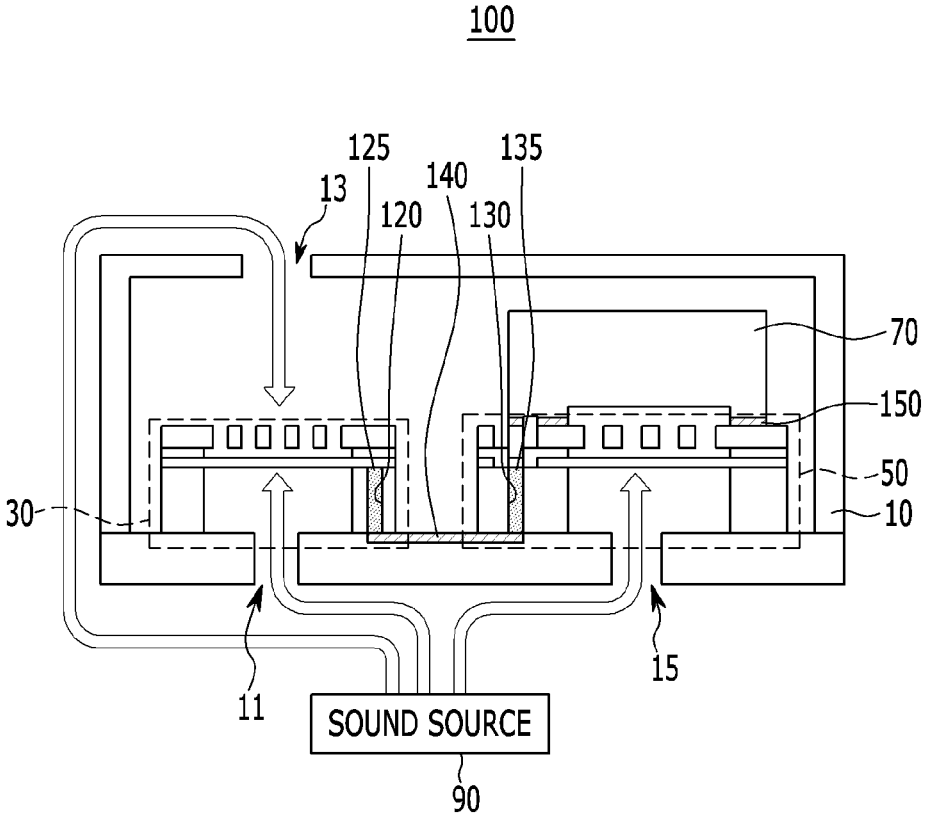
FIG. 2 is a configuration diagram illustrating a microphone according to another exemplary embodiment of the present invention.

FIG. 2 is a configuration diagram illustrating a microphone according to another exemplary embodiment of the present invention.

Referring to FIG. 2, a microphone 100 according to another exemplary embodiment of the present invention is based on the configuration illustrated in FIG. 1, wherein the first and second sound devices 30 and 50 and the semiconductor chip 70 are electrically connected to each other by a first connection part 125 and a second connection part 135 formed in the first sound device 30 and the second sound device 50.

Here, the first and second connection parts 125 and 135 are provided in a first contact hole 120 and a second contact hole 130 formed in the substrates of the first sound device 30 and the second sound device 50, respectively.

That is, the first and second sound devices 30 and 50 of the microphone according to another exemplary embodiment of the present invention have the first contact hole 120 and the second contact hole 130 formed in the respective substrates thereof, and have the first connection part 125 and the second connection part 135 provided in the first contact hole 120 and the second contact hole 130.

Here, the first and second connection parts 125 and 135 may be formed by inserting an electrical material into the first and second contact holes 120 and 130, or formed by inserting an electrode into the first and second contact holes 120 and 130.

The first and second connection parts 125 and 135 are formed of a metal material and since the first and second connection parts 125 and 135 have a very short electron transport distance, there is little reduction in the electrical signal.

Meanwhile, the case 10 of the microphone 100 according to another exemplary embodiment of the present invention further includes an electrode line 140 that electrically connects the first connection part 125 and the second connection part 135 to each other.

The electrode line 140 is formed on one side surface of the case 10 so as to connect the first connection part 125 and the second connection part 135 to each other.

In addition, the semiconductor chip 70 may be bonded to the second sound device 50 by a eutectic bonding in which the semiconductor chip 70 is electrically connected to the second sound device 50 through a bonding part 150.

Here, the semiconductor chip 70 is positioned on the second sound device 50.

The electrode line 40 and the bonding part 150 may be formed of the same material, and the material may be formed of a metal that lowers thermal resistance and has good thermal conductivity.

Therefore, since the microphone 100 according to the exemplary embodiments of the present invention processes a directional characteristic signal which is physically implemented by a package, a circuit configuration of the semiconductor chip 70 is very simple, such that cost of manufacturing the semiconductor chip 70 may be significantly saved and a uni-directional pattern may be effectively configured.

Hereinafter, a method of implementing the uni-directional microphone using the microphone according the exemplary embodiment of the present invention will be described in detail.

Figure 3:
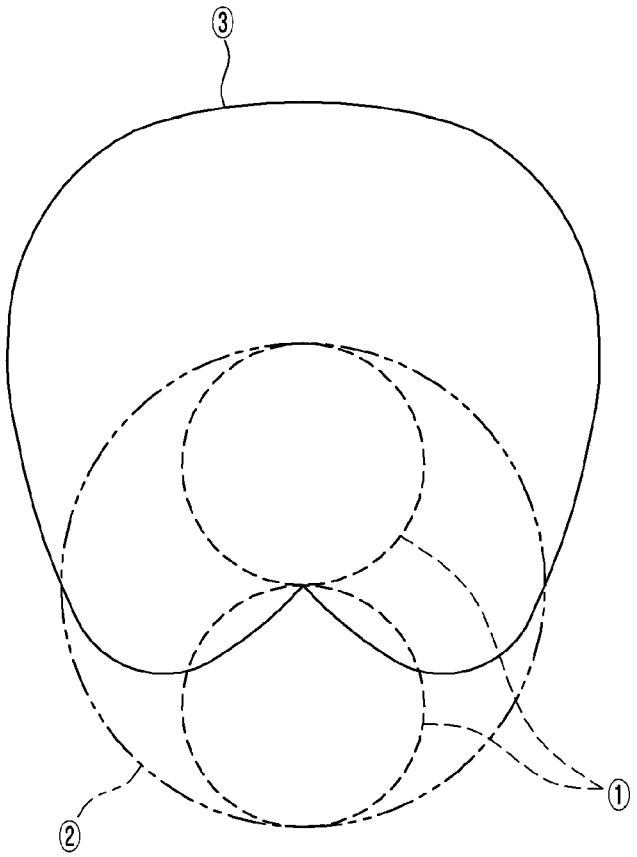
FIG. 3 is a polar pattern illustrating a method of implementing a uni-directional microphone according to an exemplary embodiment of the present invention.

FIG. 3 is a polar pattern illustrating a method of implementing a uni-directional microphone according to an exemplary embodiment of the present invention.

The first sound device 30 according to the exemplary embodiment of the present invention is the omnidirectional microphone, but is positioned in the case 10 and receives the sound signals from the sound source 90 through the first sound hole 11 and the second sound hole 13 formed in each of the upper side and the lower side of the case 10.

Therefore, since the sound signals are received from the upper side and the lower side on the basis of the vibration membrane 33 of the first sound device 30, the first sound output signal output from the first sound device 30 is the bi-directional signal (see line 1 of FIG. 3).

Here, a phase of the electrical signal output through the sound signal received from the upper side of the vibration membrane 33 of the first sound device 30 becomes a minus. In addition, a phase of the electrical signal output through the sound signal received from the lower side of the vibration membrane 33 becomes a plus.

In addition, the second sound device 50 is positioned in the case 10 and receives the sound signal from the sound source 90 through only the third sound hole 15 formed in the lower portion of the case 10.

Therefore, since the sound signal is received from the lower side on the basis of the vibration membrane 33 of the second sound device 30, the second sound output signal output from the second sound device 30 is the omnidirectional signal (see line 2 of FIG. 3).

Here, a phase of the electrical signal output through the sound signal received from the lower side of the vibration membrane 33 of the second sound device 30 becomes a plus.

The semiconductor chip 70 couples the first sound output signal and the second sound output signal to each other, thereby outputting the final sound signal, which is the uni-directional signal (see line 3 of FIG. 3).

Hereinabove, although the present invention has been described in detail with reference to the exemplary embodiment of the present invention, it is to be understood by those skilled in the art that the present invention may be variously modified and altered without departing from the scope and spirit of the present invention as disclosed in the accompanying claims.

What is claimed is:

1. A microphone comprising:

a case in which a plurality of sound holes are formed;

a first sound device mounted in the case and installed at a position corresponding to at least two sound holes formed in an upper surface and a lower surface of the case, respectively;

a second sound device mounted in the case, installed to be spaced apart from the first sound device by a predetermined interval, and installed at a position corresponding to another sound hole formed in the case; and a semiconductor chip electrically connected to the first sound device and the second sound device, wherein the first sound device receives sound source signals through each of the at least two sound holes formed in the upper and lower surfaces of the case and transmits a first sound output signal, which is a bi-directional signal, to the semiconductor chip, and the semiconductor chip receives a second sound output signal, which is an omnidirectional signal, from the second sound device, and outputs a final sound signal, which is a uni-directional signal, using the first sound output signal and the second sound output signal.

2. The microphone of claim 1, wherein:

the first sound device and the second sound device are omnidirectional sound devices.

3. The microphone of claim 1, wherein:

the semiconductor chip is electrically connected to each of the first sound device and the second sound device by a wire.

4. The microphone of claim 1, wherein:

the semiconductor chip is positioned on the second sound device.

5. The microphone of claim 1, wherein:

each of the first sound device and the second sound device includes a substrate, a vibration membrane formed over the substrate, and a fixed membrane formed over the vibration membrane to be spaced apart from the vibration membrane by a predetermined interval;

a first contact hole formed in the substrate of the first sound device;

a second contact hole formed in the substrate of the second sound device; and a first connection part and a second connection part formed in the first contact hole and the second contact hole, respectively.

6. The microphone of claim 5, wherein:

the case further includes an electrode line that electrically connects the first connection part and the second connection part to each other.

7. The microphone of claim 6, wherein:

the semiconductor chip is electrically connected to the second sound device through a bonding part on the second sound device.

8. The microphone of claim 7, wherein:

the electrode line and the bonding part are formed of the same material.

9. A microphone comprising:

a first sound device receiving a sound source signal and outputting a first sound output signal;

a second sound device formed to be spaced apart from the first sound device by a predetermined interval, receiving the sound source signal and outputting a second sound output signal;

a case in which the first sound device and the second sound device are positioned, a first sound hole and a second sound hole are formed in an upper side and a lower side of the first sound device, respectively, and a third sound hole is formed in a position corresponding to the second sound device; and a semiconductor chip positioned on the second sound device and outputting a final sound signal based on the first sound output signal and the second sound output signal, wherein the first sound device receives the sound source signal through each of the first sound hole and the second sound hole and transmits the first sound output signal, which is a bi-directional signal, to the semiconductor chip, and the second sound device receives the sound source signal through the third sound hole and transmits the second sound output signal, which is an omnidirectional signal, to the semiconductor chip.

10. The microphone of claim 9, wherein:

the semiconductor chip outputs the final sound signal, which is a uni-directional signal, using the first sound output signal and the second sound output signal.

11. A microphone comprising:

a case in which a first sound hole and a second sound hole are formed in an upper side and lower side, respectively, and a third sound hole is formed;

a first sound device positioned between the first sound hole and the second sound hole in the case;

a second sound device formed at a position corresponding to the third sound hole in the case; and a semiconductor chip positioned on the second sound device, wherein each of the first sound device and the second sound device includes a substrate, a vibration membrane formed over the substrate, and a fixed membrane formed over the vibration membrane to be spaced apart from the vibration membrane by a predetermined interval, and the first sound device and the second sound device are electrically connected to each other through a first connection part and a second connection part formed in the respective substrates.

12. The microphone of claim 11, wherein:

the first connection part and the second connection part are each formed in a first contact hole and a second contact hole formed in the first sound device and the second sound device.

13. The microphone of claim 12, wherein:

the case further includes an electrode line that electrically connects the first connection part and the second connection part to each other.

14. The microphone of claim 11, wherein:

the semiconductor chip is electrically connected to the second sound device through a bonding part on the second sound device.

* * * * *